United States Patent [19]

Olsson

[11] Patent Number: 4,501,027

[45] Date of Patent: Feb. 26, 1985

[54] QUICK RELEASE WEIGHT BELT AND BUCKLE THEREFOR

[76] Inventor: Mark S. Olsson, 4968 Diane Pl., San Diego, Calif. 92117

[21] Appl. No.: 423,630

[22] Filed: Sep. 27, 1982

[51] Int. Cl.[3] ..... A41F 9/00

[52] U.S. Cl. ..... 2/321

[58] Field of Search ..... 2/321; 24/170, 182, 24/191, 69 R, 68 CD, 200, 193

[56] References Cited

U.S. PATENT DOCUMENTS

| | | | |
|---|---|---|---|
| 311,101 | 1/1885 | Blomstrom . | |
| 798,605 | 9/1905 | Hamilton | 24/170 |
| 2,822,595 | 2/1958 | Ruhl | 24/170 |
| 3,165,803 | 1/1965 | Gaylord | 24/225 |
| 3,253,309 | 5/1966 | Baresch | 24/170 |
| 3,342,036 | 9/1967 | Gruget | 61/70 |
| 3,346,930 | 10/1967 | Browning | 24/265 |
| 3,415,211 | 12/1968 | Hampton | 114/16 |
| 4,198,732 | 4/1980 | Rieth et al. | 24/191 |

OTHER PUBLICATIONS

Skin Diver Magazine, Jul. 1982, p. 77, single page advertisement regarding weight belts and buckles #140-152.

Single page advertisement relating to DAC8R weight belt models CWB, DBS and DBA.

Photocopy of photograph of NEMROD weight belt.

Single pages advertisement relating to buckles 360, 361, weight belts 350-353, hardware and webbing.

Single page advertisement relating to weight belts 7125 and 7105.

Single page advertisement relating to SEATEC weight belts.

Single page advertisement relating to C-99 Neoprene weight belt.

Single page advertisement relating to "Quick Flip" belt, Bullet weight belts, the FLEX-BELT and plastic buckles.

Single page advertisement relating to standard nylon weight belt, compensation weight belt, and s/s buckle set.

Article "A weight belt is not a wait belt" SKIN DIVER MAGAZINE.

Single page from SKIN DIVER MAGAZINE illustrating pilots quick release buckle and quick release buckle.

*Primary Examiner*—Ronald Feldbaum

*Attorney, Agent, or Firm*—Baker, Maxham, Callan & Jester

[57] ABSTRACT

A weight belt which a diver can release quickly and swing free and clear of the diver's legs and gear with one hand in case of an emergency. The ends of a waist encircling piece of webbing are threaded through corresponding male and female parts of a buckle. The male part has a transversely extending hook formed at a forward end thereof. The female part has a transversely extending post at a forward end thereof and a transversely extending hook receiving cavity. The hook can be inserted into the cavity to engage and surround the post when the male and female parts of the buckle extend substantially at a right angle relative to one another. The male and female parts can thereafter be rotated so that they are in substantial longitudinal alignment and lie flat against the diver's body. The male and female parts cannot more transversely or longitudinally with respect to each other in this alignment. A release knob may be pulled with one hand to rotate the male part of the buckle through a sufficient angle relative to the female part so that the parts will disengage.

20 Claims, 9 Drawing Figures

FIG. 1
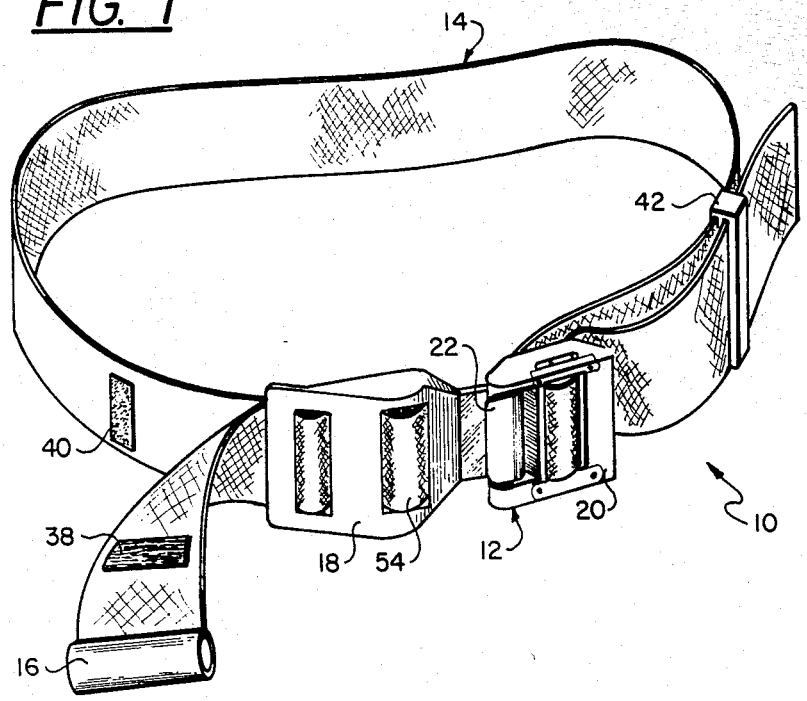
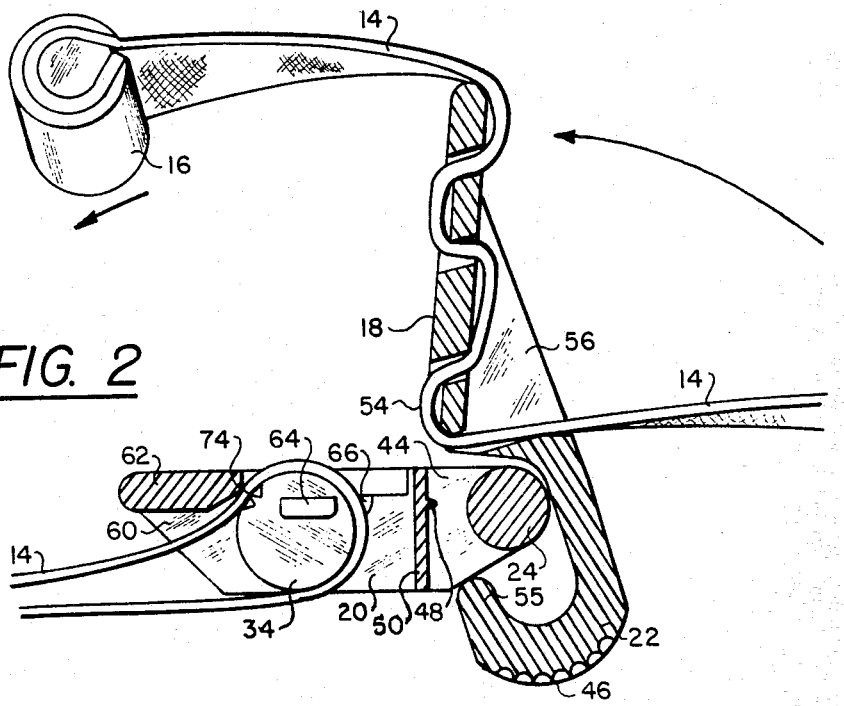
FIG. 2

QUICK RELEASE WEIGHT BELT AND BUCKLE THEREFOR

BACKGROUND OF THE INVENTION

The present invention relates to skin diving equipment, and more particularly, to a weight belt which a diver can quickly release and swing free and clear of the diver's legs and gear with one hand in case of an emergency.

A skin diver wears a weight belt to offset the positive buoyancy of the body and the wet suit to thereby facilitate descent. In an emergency, such as an air supply failure, it is imperative for a diver to be able to get to the surface in a short amount of time. Therefore, it is desirable to have a weight belt which can be quickly discarded. However, it is important that the weight belt not disconnect inadvertently since the diver could ascend in an uncontrolled manner which could result in an air embolism and death.

If the weight belt is to be quickly released, it should have some mechanism for enabling the diver to readily distinguish its release strap from all others. This is important because diving masks, head gear and front flotation vests usually restrict the diver's ability to view his or her waist area. Furthermore, heavy gloves often make it difficult to tell one strap or buckle from another. Divers may wear a tank harness buckle, a flotation harness buckle and other buckles.

The most commonly used diver's weight belt buckle is the cam buckle available in stainless steel or plastic. This type of buckle has several shortcomings. The end of the webbing must be threaded through the buckle. This is often difficult to do when the diver has heavy gloves on and the view of his or her waist is obstructed by the mask or other diving gear. In this type of belt, if the end of the webbing becomes frayed, it can be very difficult to feed the webbing underneath the cam. It is considered good safety practice for a diver to put on the weight belt last in order to insure that it can be readily removed and is not trapped by another piece of gear. Because the conventional cam buckle is difficult to put on, some divers are inclined to violate this rule. It is also very difficult to re-thread a cam type weight belt underwater.

On older designs of the cam type weight belt buckle, it was possible to feed the webbing partially underneath the buckle itself so that the cam was just barely engaged and the weight belt could be inadvertently lost. If the cam is rotated more than twenty degrees, for example, the belt can release. Two hands are required to loosen, tighten and release in a controlled fashion the cam type of buckle. This type of buckle can be released using one hand, but the diver then has little control over the manner in which the belt drops. It is thus possible for the weight belt to become lodged, for example, on a knife worn on the diver's ankle. The cam type weight belt buckle can become hooked on rocks, kelp or lines, and be accidentally released.

By virtue of its geometry, the conventional cam type weight belt buckle is prone to damage. The metal versions often get bent. The pin that retains the cam may become damaged or even lost. Because of its construction, a high level of stress is concentrated on the pivot point. In plastic versions of the cam type weight belt buckle, this can lead to failure or contribute to breakage.

Cam type weight belt buckles can jam upon release where a long section of the webbing has been threaded through the buckle. This jamming results by a cocking action of the webbing in the buckle. In addition, the cam type buckle has a tendency to slip if a large number of weights are used as in the case of dry suit diving.

The only other type of diver's weight belt buckle that is widely utilized in the United States is a bent wire buckle, that is mated with a heavy rubber belt. While this type of weight belt solves some of the problems associated with the cam type buckle, the wire buckle is not easily adjusted and the rubber strap is found to be undesirable by many divers. The bent wire buckle weight belt cannot be readily released using only one hand.

SUMMARY OF THE INVENTION

Accordingly, it is the primary object of the present invention to provide an improved weight belt for skin divers.

It is another object of the present invention to provide a diver's weight belt which can readily be released with one hand and dropped free and clear of the diver.

Another object of the present invention is to provide a diver's weight belt which is easy for the diver to put on without seeing the belt.

Yet another object of the present invention is to provide a diver's weight belt which can be quickly released by the diver but will not release inadvertently.

Still another object of the present invention is to provide a diver's weight belt which can be readily adjusted.

Finally, another object of the present invention is to provide an improved buckle for use on weight belts and in non-diving applications.

Accordingly, the present invention provides a weight belt which a diver can release quickly and swing free and clear of the diver's legs and gear with one hand in case of an emergency. The ends of a waist encircling piece of webbing are threaded through corresponding male and female parts of a buckle. The male part has a transversely extending hook formed at a forward end thereof. The female part has a transversely extending post at a forward end thereof and a transversely extending hook receiving cavity. The hook can be inserted into the cavity to engage and surround the post when the male and female parts of the buckle extend substantially at a right angle relative to one another. The male and female parts can thereafter be rotated so that they are in substantial longitudinal alignment and lie flat against the diver's body. The male and female parts cannot move transversely or longitudinally with respect to each other in this alignment. A release knob may be pulled with one hand to rotate the male part of the buckle through a sufficient angle relative to the female part so that the parts will disengage.

BRIEF DESCRIPTION OF THE DRAWINGS

FIG. 1 is a perspective view of a preferred embodiment of my diver's weight belt with the male and female parts of its buckle connected.

FIG. 2 is an enlarged top view with portions broken away illustrating the manner in which the buckle of the preferred embodiment is released by pulling on the knob of the weight belt.

DESCRIPTION OF THE PREFERRED EMBODIMENT

Figure 3:
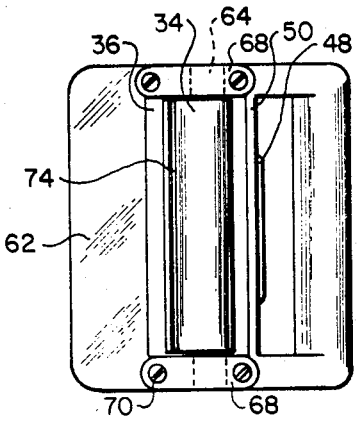
FIG. 3 is an enlarged top plan view of the female part of the buckle of the preferred embodiment.

Referring to FIG. 1, the preferred embodiment of my diver's weight belt 10 comprises a buckle 12, a length of webbing 14 and a release knob 16 connected to one terminal end of the webbing. The buckle 12 has a male part 18 formed of an elongate body and a female part 20 also formed of an elongate body. A transversely extending hook 22 formed at the forward end of the male part engages and surrounds a transversely extending post 24 (FIG. 5) formed at the forward end of the female part when the male and female parts of the buckle are connected.

A first end of the webbing 14 is threaded through four transversely extending slots 26, 28, 30 and 32 (FIG. 4) as illustrated in FIGS. 1 and 2. The other end of the webbing 14 is threaded around a transversely extending slide bar 34 (FIGS. 2, 3 and 5) mounted for longitudinal sliding motion within a transverse slot 36 (FIG. 3) formed in a remaining portion of the female part 20 of the buckle. The terminal end of the webbing 14 having the release knob 16 connected thereto may be secured to the portion of the webbing which encircles the diver's waist by mating hook-weave connecting surfaces 38 and 40. These surfaces may be made of material such as that sold under the trademark Velcro.

A portion of the webbing 14 which encircles the diver's waist is threaded through one slot of a dual slot keeper 42 (FIG. 1). The other terminal end of the webbing is threaded through the other slot of the keeper 42. The portion of the webbing 14 which extends between the male and female parts of the buckle has sufficient length to encircle the diver's waist. The belt can be adjusted to fit waists of different sizes by threading the web around the slide bar 34 and through the keeper and/or by threading the webbing through the four slots in the male part. In the latter case, it may be necessary to attach the hook-weave connecting surfaces 38 and 40 at different locations.

Diver's weights may be placed on the belt by unthreading the end of the webbing from the keeper 42 and the female part of the buckle. Thereafter, the desired number of weights are slid onto the webbing. The end of the webbing is then re-threaded through the female part and back through the keeper.

Figure 5:
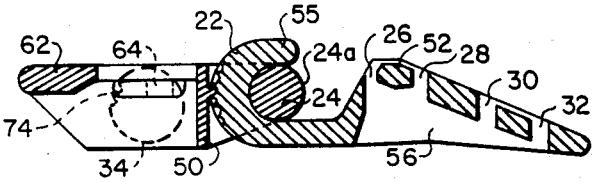
FIG. 5 is an enlarged sectional view through the connected buckle of the preferred embodiment. The webbing of the belt is not illustrated in this Figure.

As illustrated in FIG. 2, the female part 20 of the buckle has a transversely extending cavity 44 formed therein which separates the post 24 at the forward end from the remaining portion of the body. The hook 22, post 24 and cavity 44 are dimensioned and configured so that the hook can be inserted into the cavity to engage and surround the post when the male and female parts of the buckle extend substantially at a right angle relative to one another. The male and female parts may thereafter be rotated relative to each other until they are in substantial longitudinal alignment as illustrated in FIGS. 1 and 5. When the belt is wrapped around a diver's waist and the buckle is connected in this fashion, the buckle will lie flat against the diver's waist. The tension on the webbing will keep the male and female parts connected. The buckle is thus easy to connect and does not require that the diver be able to observe his or her waist during the connection procedure. The hook and cavity are dimensioned so that when connected and in longitudinal alignment, the male and female parts cannot move transversely or longitudinally with respect to one another. Release of the belt can only be effected by adequate relative rotation of the male and female parts.

When the diver desires to take off the belt, he or she simply pulls outwardly and forwardly on the knob 16 as illustrated by the arrows in FIG. 2. This causes the male part 18 of the buckle to rotate out of longitudinal alignment with the female part 20 of the buckle. Once the male part pivots through substantially a ninety degree angle, the hook 22 pulls clear of the post 24, thus disconnecting the buckle. In addition, the buckle is easily disconnected with one hand and the knob provides a convenient way for the diver to hold onto the belt and drop it clear in the event of an emergency. The knob also permits the diver to distinguish the weight belt from other belts that he or she may be wearing, for example belts for the tank or flotation devices.

The knob provides a positive grip point to pull against in effecting release of the buckle and hence the weight belt. The knob also makes the weight belt easy to hold onto after it has been released. This is important for at least two reasons. First, in the case of an emergency, the weight belt can be swung free and clear of the diver's legs and gear so that the weight belt can be dropped free and clear. Secondly, during removal following a dive, the weight belt can be removed and controlled with one hand. This is especially convenient when entering a boat or when carrying additional gear in the other hand.

Figure 4:
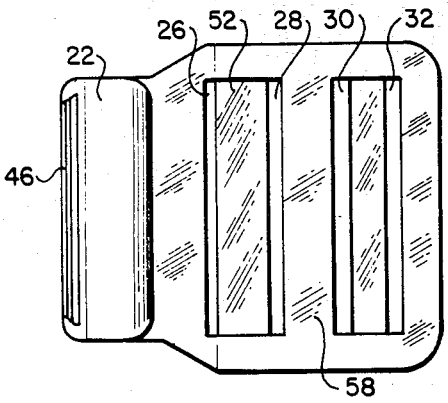
FIG. 4 is an enlarged top plan view of the male part of the buckle of the preferred embodiment.

Details of the construction of my weight belt will now be described. The buckle incorporates ratchet means for holding the male and female parts in substantial longitudinal alignment when they have been connected. This ratchet means is readily overcome to permit the male and female parts to be disconnected when sufficient pulling force is applied to the knob 16. More specifically, as best seen in FIGS. 2 and 4, the outer surface of the hook 22 is provided with a plurality of circumferentially spaced, transversely extending detents 46. As illustrated in FIGS. 2 and 3, the female part of the buckle is provided with a transversely extending rib 48 for engaging the detents 46. The rib 48 is formed on a resilient transverse wall 50 of the female part of the buckle. The rib extends into the cavity 44 opposite the post. The buckle 12 is preferably molded of plastic and the thickness of the wall 50 is chosen so that it will flex a very small amount left and right in FIG. 2 when the hook 22 is inserted into the cavity and the rib 48 jumps from detent to detent as the hook is rotated.

The ratchet mechanism of the buckle is important for several reasons. First of all, it helps to prevent the buckle from releasing if the webbing becomes slack. Secondly, the ratchet mechanism helps hold the male and female parts in substantial longitudinal alignment as illustrated in FIGS. 1 and 5. Thirdly, it is psychologically satisfying to the diver to have a ratchet action when the buckle is being connected. This greatly enhances the security of the buckle as perceived by the diver.

The geometry of the male part of the buckle permits the webbing to be inserted from the waist portion underneath the male part through the slot 26 as illustrated in FIGS. 1 and 2. The webbing then is reinserted into the male part through the slot 28. The positions of the slots 26 and 28 and of the bar 52 therebetween is such that the center of curvature of the first loop 54 (FIGS. 1 and 2) is above the center of rotation of the hook. The center of rotation of the hook is the center of the cylindrical post 24. This relationship causes the male part of the buckle to be pulled against diver's waist when the buckle is connected and the webbing is under tension due to the heavy weights carried thereby.

The male part of the buckle is also configured so that the point of insertion of the webbing is as far forward toward the hook 22 as possible. In other words, the slot 26 is located as far forward on the male part as possible. The farther forward the insertion point of the webbing, the easier the buckle is to release, i.e., less pulling force on the knob is required. When the male part is rotated to effect release, the webbing around the waist shortens and hence tightens. This is minimized when the insertion point of the webbing into the male part of the buckle from the waist is moved closer to the center of rotation of the hook. The degree to which the insertion point of the webbing can be moved forward toward the hook and up, i.e., away from the wearer's waist, is limited. The insertion point cannot be so far forward that the webbing will interfere with the post on the female part to inhibit release. The hook may not fully rotate and effect release if the point of insertion is too far forward.

As illustrated, the hook preferably terminates on the upper side of the male part of the buckle. Preferably, the curved portion of the hook extends through approximately one-hundred and eighty degrees. The straight terminal end 55 (FIG. 2) of the hook 22 should terminate within a well defined range to allow release of the buckle within a reasonable range of rotation angles. To achieve this result, the straight end of the hook 22 should terminate between the center axis of the post and just slightly beyond the forward edge 24*a* of the post when the male and female parts are connected and longitudinally aligned as in FIG. 5.

The non-hook portion of the male part comprises a spaced apart pair of triangular side pieces 56 (FIGS. 2 and 5) connected by a flat top piece 58 (FIG. 4) which slopes downwardly in a rearward direction, i.e., away from the hook. The slots 26, 28, 30 and 32 are formed in the top piece 58. The female part 20 of the buckle includes a pair of slide pieces 60 (FIG. 2) of generally trapezoidal configuration which connect the ends of the post 24, the wall 50, and the ends of a rear top plate 62.

Where the belt is to be utilized as a weight belt, the webbing 14 is preferably very stiff. Soft webbing tends to twist easily and tends to be easily collapsed by heavy weights. Because the webbing 14 in my preferred embodiment is very stiff, the slide bar 34 has as large a diameter as geometrically possible to reduce the friction caused by bending the webbing around a small radius. The slide bar is mounted so that rearward sliding movement thereof (to the left in FIG. 2) will cause the webbing to be pinched against the forward end of the top panel 62. Thus, the normal tension on the webbing 14 causes the webbing to be pinched by the slide bar mechanism. This prevents the webbing from feeding through the slot 36 and untightening from around the diver's waist. The slide bar 34 preferably has a substantially smooth cylindrical outer surface. All other slide bar mechanisms in buckles which are known to me have used a textured or knurled slide bar.

As illustrated in FIG. 5, the slide bar 34 has a generally smooth, cylindrical cross section. A pair of guide tabs 64 extend from opposite ends of the slide bar and are positioned in corresponding guide openings 66 (FIG. 2) formed in the side pieces 60 of the female part of the buckle. A pair of removable retaining bars 68 (FIGS. 2 and 3) extend over corresponding ones of the guide openings to hold the slide bar within the slot 36 of the female part of the buckle. These retaining bars are held in place by screws 70 at each end. Glue or ultrasonic welding may also be used to affix the retaining bars. The retaining bars fit within corresponding recesses 72 (FIG. 2) formed in the upper edges of the side pieces 60. Alternately, the retaining bars could be integrally molded as a portion of the female part. The slide bar could have an axial slot through its center. A single long tab would insert through the sidewalls 60 and through the axial slot in the slide bar. The tab could have a snap construction so that it would lock into place.

As illustrated in FIG. 5, the guide tabs 64 at each end of the slide bar are offset above the axial center of the slide bar. The webbing 14 which wraps around the slide bar is pinched between the slide bar and the forward edge of the top panel 62 (FIG. 2) at a location above the axial center of the slide bar. The forward edge of the top panel 62 may be smooth or serrated. This reduces the amount of bending that the webbing must undergo in passing through the mechanism. This in turn reduces the force needed to tighten or loosen the belt. The pinching force is increased as the pinching point is raised up higher and higher above the center of the slide bar. As illustrated in FIG. 5, the slide bar has a transversely extending engagement tooth 74 whose peak coincides with the circumference of the slide bar. The tooth is positioned so that it is adjacent the forward edge of the top panel 62 for facilitating gripping action of the webbing. The result of placing the engagement tooth 74 on the slide bar, rather than on the top panel 62, is that when the webbing is pulled to tighten the belt, the webbing is lifted away from the engagement tooth, thereby reducing friction.

Figure 6:
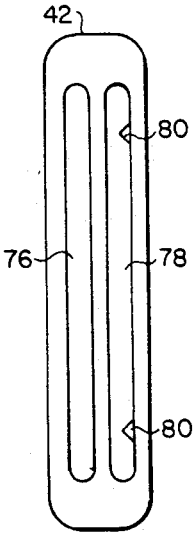
FIGS. 6 and 7 are enlarged views of the dual slot keeper utilized in the preferred embodiment to hold down the end of the webbing which does not have the knob connected thereto.
Figure 7:
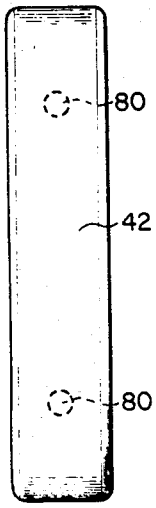

The keeper 42 (FIGS. 6 and 7) has a pair of closely spaced upper and lower narrow slots 76 and 78 formed therein. The length of these slots is slightly greater than the width of the webbing 14 and the width of these slots is slightly greater than the thickness of the webbing. As illustrated in FIG. 1, the portion of the webbing which encircles the person's waist extends through the lower slot 78 of the keeper 42. The second end of the webbing, after it has been threaded around the slide bar of the female part of the buckle, is threaded through the upper slot 76 of the keeper. The keeper has one or more pointed projections 80 (FIGS. 6 and 7) which extend into the lower slot 78 for impeding sliding motion of the waist encircling portion of the webbing therethrough. These projections thus serve to hold the keeper at a specific location on the waist encircling portion of the webbing such as the location illustrated in FIG. 1. However, the second end of the webbing can be freely threaded through the upper slot 76 of the keeper when length adjustments to the belt are being made.

Figure 8:
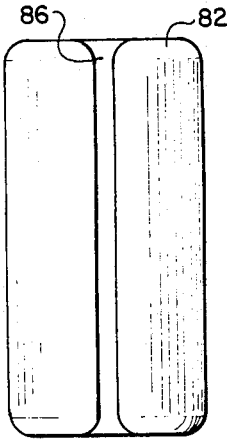
FIGS. 8 and 9 are enlarged views illustrating the release knob of the preferred embodiment and manner in which it is connected to one end of the webbing of the belt.
Figure 9:
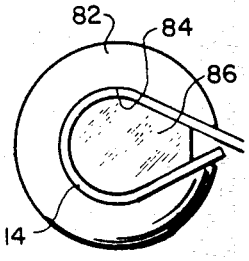

FIGS. 2, 8 and 9 illustrate details of the release knob 16 and manner in which it is attached to the terminal portion of the first end of the webbing. Specifically, the knob includes a large outer cylinder 82 having a height substantially equal to the width of the webbing 14. The cylinder 82 has a large, axially extending bore 84 and an axially extending access opening 86 in the side wall thereof. The curled terminal part of the webbing is inserted into the bore of the cylinder 84. A generally cylindrical plug 86 is inserted into the center of the curled terminal portion of the webbing to squeeze the webbing tightly against the inner wall of the cylinder 82. The bore 84 and the plug 86 preferably have a teardrop cross section. The bore surfaces and the plug can have ridges (not illustrated) to increase pull out resistance. The access opening 86 in the outer cylinder 82 permits the walls of the cylinder 82 to expand slightly and the wedge action of the plug 86 facilitates insertion. In order for the walls of the cylinder 82 to be able to expand in this manner the cylinder is preferably made of a resilient plastic material.

When my weight belt is used, the diver need only engage the hook of the male part with the post of the female part in order to connect the buckle. The ends of the webbing do not have to be inserted into anything. Due to the construction of the buckle, it is nearly impossible to mismate the two sections of the buckle. Two hands are required for donning the weight belt, but only one hand is needed to effect release. The belt is then left in the hand under the control of the diver. It is possible to both loosen and tighten the belt using only one hand, although it is somewhat easier to use two hands.

The construction of the buckle utilizes thick cross-sections of material so that the stress is widely distributed. Preferably, the buckle, release knob and keeper are molded of a plastic material such as nylon or polycarbonate which are impact resistant. A very rigid material is not preferred, rather a resilient plastic material is more desirable so that the buckle can flex. While it is preferred to injection mold the buckle and other components out of suitable plastic, the buckle might also be investment casted in some metal. However, this may require slight modifications to the ratchet and other mechanism.

The preferred embodiment of my buckle which is illustrated can be easily released by rotating the male part through about ninety degrees. However, a continuous pull is required to rotate the male part through such an angle, in order to effect release. This substantially reduces the possibility of accidental release. It should be noted that the webbing does not slide through a slot upon release so that the buckle is nearly jam proof. The buckle resists slippage because the tension on the webbing 14 encircling the waist increases the pinching forces between the slide bar and the top panel 62.

My belt and buckle are not necessarily restricted to use in weight belts. By deleting the release knob, the belt can be used in scuba tank and buoyancy harnesses. The belt and buckle can also be used in non-diving applications. The use of the release knob exclusively on the weight belt should continue to distinguish the weight belt from other belts that the diver may be wearing.

In certain applications, soft or elastic webbing, or a rubber belt, may be preferred and can be used with my belt and buckle.

Various other handle means could be utilized in place of the release knob 16. The terminal end of the webbing can be provided with some other type of body or other mechanism for permitting ready grasping by the diver. The body on the end of the webbing could be completely eliminated and the trailing edge of the male half of the buckle could be flared or otherwise shaped to be grasped and rotated.

Having described a preferred embodiment of my diver's weight belt and buckle therefor, it should be apparent to those skilled in the art that my invention may be modified in both arrangement and detail. Accordingly, the protection afforded my invention should be limited only in accordance with the scope of the following claims.

I claim:

1. A belt comprising:

a buckle having a male part and a female part;

the male part being formed of an elongate first body having a transversely extending hook formed at a forward end thereof and at least one transversely extending slot formed in the remaining portion of the first body;

the female part being formed of a second elongate body having a transversely extending post at a forward end thereof and a transversely extending cavity separating the post from the remaining portion of the second body, the hook, post and cavity being dimensioned and configured so that the hook can be inserted into the cavity to engage and surround the post when the first and second bodies extend at an angle relative to one another and so that the bodies can thereafter be rotated so that they are in substantial longitudinal alignment, the remaining portion of the second body having at least one transversely extending slot;

an elongate piece of webbing having a first end threaded through the slot in the first body and a second end threaded through the slot in the second body, the length of the webbing being sufficient so that the portion extending between the male and female parts of the buckle can encircle a person's waist when the hook is in engagement with the post and the first and second bodies are in longitudinal alignment; and handle means attached to the first end of the webbing for permitting a person to pull the first end of the webbing to rotate the first body from substantial longitudinal alignment and engagement with the second body through a sufficient angle so that the bodies will disengage.

2. A belt according to claim 1 and further comprising ratchet means for holding the first and second bodies in substantial longitudinal alignment when the hook is engaged with the post and for permitting relative rotation of the bodies when sufficient pulling force is applied to the handle means.

3. A belt according to claim 2 wherein the ratchet means comprises a plurality of circumferentially spaced, transversely extending detents formed in the outer surface of the hook and a transversely extending rib for engaging the detents extending into the cavity opposite the post and formed on a resilient transverse wall of the remaining portion of the second body.

4. A belt according to claim 1 wherein the first body has a bottom side and a top side, the hook terminates on the top side of the first body, and the curved portion of the hook extends through substantially one-hundred and eighty degrees.

5. A belt according to claim 4 wherein the first body has a pair of transversely extending spaced apart slots in the remaining portion positioned for having the first end of the webbing threaded therethrough into a loop whose center of curvature is above the center of rotation of the hook.

6. A belt according to claim 5 wherein the forward one of the slots in the first body is positioned at the forward end of the remaining portion of the first body to minimize the amount that the webbing tightens around the person's waist when the first body is rotated to disengage it from the second body.

7. A belt according to claim 1 and further comprising a keeper having of upper and lower slots therein, the portion of the webbing which is provided for encircling the person's waist extending through the lower slot of the keeper and the second end of the webbing extending through the upper slot of the keeper, the keeper further having means extending into the lower slot for impeding sliding motion of the webbing therethrough.

8. A belt according to claim 1 and further comprising a pair of hook weave connecting surfaces, one attached to an outer surface of the portion of the webbing provided for encircling the waist and the other attached to an inner surface of the first end of the webbing adjacent the handle and adapted to be mated to secure the handle in a position for ready grasping by the user.

9. A belt according to claim 1 wherein the remaining portion of the second body has a transversely extending slide bar mounted within its slot for longitudinal sliding motion, the slide bar having the second end of the webbing looped therearound, the slide bar having a smooth, generally cylindrical cross-section.

10. A belt according to claim 1 wherein the handle means comprises a cylindrical knob having an axially extending bore and an access opening for receiving the curled terminal portion of the first end of the webbing and a generally cylindrical plug inserted into the center of the curled terminal portion to squeeze the terminal portion of the webbing tightly against the portions of the cylindrical knob defining the axially extending bore.

11. A buckle comprising:

a male part formed of an elongate first body having a top side, a bottom side, a transversely extending hook formed at a forward end thereof and terminating on the top side of the first body, and at least one transversely extending slot formed in a remaining portion of the first body for having a length of webbing threaded therethrough;

a female part formed of a second elongate body having a top side, a bottom side, a transversely extending post at a forward end of the second body and a transversely extending cavity separating the post from the remaining portion of the body, the hook, post and cavity being dimensioned and configured so that the hook can be inserted into the cavity to engage and surround the post when the first and second bodies extend at an angle relative to one another and so that the bodies can thereafter be rotated so that they are in substantial longitudinal alignment and relative transverse or longitudinal movement of the bodies is substantially limited, the remaining portion of the second body having at least one transversely extending slot; and slide bar means extending transversely within the slot in the second body for having the webbing looped therearound, the slide bar means being longitudinally slidable relative to the second body to bind the webbing against the remaining portion of the second body.

12. A buckle according to claim 11 and further comprising ratchet means for holding the first and second bodies in substantial longitudinal alignment when the hook is engaged with the post and for permitting relative rotation of the bodies when sufficient rotational force is applied to the first body.

13. A buckle according to claim 12 wherein the ratchet means comprises a plurality of circumferentially spaced, transversely extending detents formed in the outer surface of the hook and a transversely extending rib extending into the cavity opposite the post for engaging the detents and formed on a resilient transverse wall of the remaining portion of the second body.

14. A buckle according to claim 11 wherein the first body has a pair of transversely extending spaced apart slots in the remaining portion positioned for having the webbing threaded therethrough into a loop whose center of curvature is above the center of rotation of the hook.

15. A buckle according to claim 14 wherein the forward one of the slots in the first body is positioned at the forward end of the remaining portion of the first body.

16. A buckle according to claim 11 wherein the slide bar means includes a pair of guide holes formed in the remaining portion of the second body in the portions thereof defining the end of the slot in the second body, a slide bar having a smooth, generally cylindrical cross-section and a pair of guide tabs extending from opposite ends of the slide bar and positioned in corresponding ones of the guide openings, and a pair of retaining bars extending over corresponding ones of the guide openings to hold the slide bar within the slot of the second body.

17. A buckle according to claim 11 wherein the slide bar means includes a cylindrical slide bar and the webbing in pinched between the slide bar and the remaining portion of the second body at a location above the axial center of the slide bar.

18. A buckle according to claim 16 wherein the cylindrical slide bar has a transversely extending engagement tooth whose peak coincides with the circumference of the slide bar.

19. A buckle according to claim 11 wherein the remaining portion of the first body has a pair of generally triangular side piece and an upper surface which tapers downwardly in a rearward direction.

20. A buckle according to claim 11 wherein the post of the female part is cylindrical and has a diameter slightly smaller than the inside diameter of the hook, and the curved portion of the hook extends through substantially one-hundred and eighty degrees.

* * * * *